US006263512B1

(12) United States Patent
LeDonne

(10) Patent No.: US 6,263,512 B1
(45) **Date of Patent: *Jul. 24, 2001**

(54) PLIABLE GARMENT TO BE WORN ABOUT THE HEAD

(76) Inventor: Eileen A. LeDonne, 16 Green St., Everett, MA (US) 02149

( * ) Notice: Subject to any disclaimer, the term of this patent is extended or adjusted under 35 U.S.C. 154(b) by 0 days.

This patent is subject to a terminal disclaimer.

(21) Appl. No.: 09/244,918

(22) Filed: Feb. 4, 1999

Related U.S. Application Data

(63) Continuation-in-part of application No. 08/770,459, filed on Dec. 20, 1996, now Pat. No. 5,867,833.

(51) Int. Cl.[7] ..... A42B 19/02

(52) U.S. Cl. ..... 2/171; 2/207; 2/DIG. 11; 132/273

(58) Field of Search ..... 2/171, 207, DIG. 11, 2/311, 312, 338, 909; 128/97.1, 856; 132/273

(56) References Cited

U.S. PATENT DOCUMENTS

| | | | | |
|---|---|---|---|---|
| 2,560,267 | * | 7/1951 | Baker et al. | 2/DIG. 11 |
| 4,833,734 | * | 5/1989 | Der Estephanian | 2/171 |
| 5,038,412 | * | 8/1991 | Cionni | 2/209 |
| 5,233,704 | * | 8/1993 | Booher | 2/207 |
| 5,655,224 | * | 8/1997 | Sears | 2/171 |
| 5,867,833 | * | 2/1999 | LeDonne | 2/171 |
| 5,930,842 | * | 8/1999 | Burruss | 2/452 |

* cited by examiner

*Primary Examiner*—John J. Calvert
*Assistant Examiner*—Katherine Moran
(74) *Attorney, Agent, or Firm*—Kudirka & Jobse, LLP

(57) ABSTRACT

An article of apparel to be worn about the head includes an elongate sleeve of material having an elongate pliable member extending at least partially through the sleeve. The ends of the article are securable about the head so that at least a portion of the head and ears are covered, with the pliable member providing all or a portion of the facilities for securing and maintaining the device about the head.

11 Claims, 8 Drawing Sheets

Figue 4A

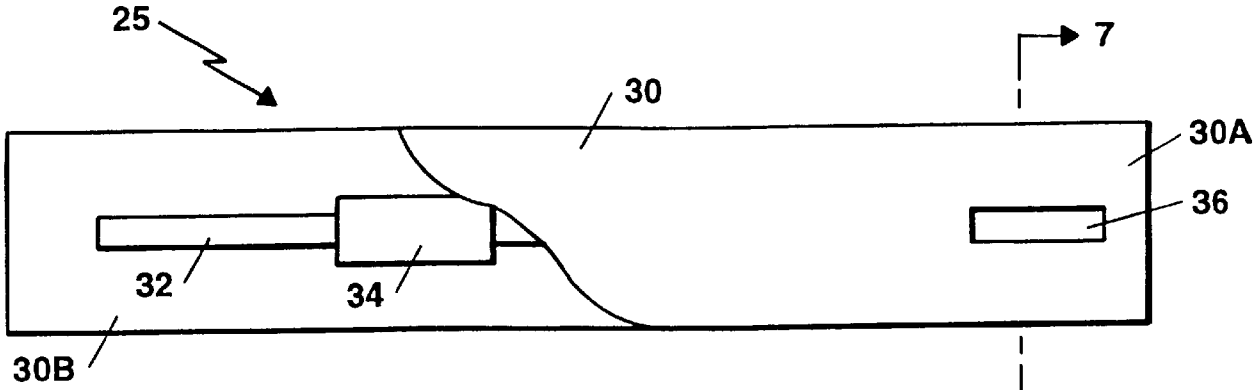
Figure 6
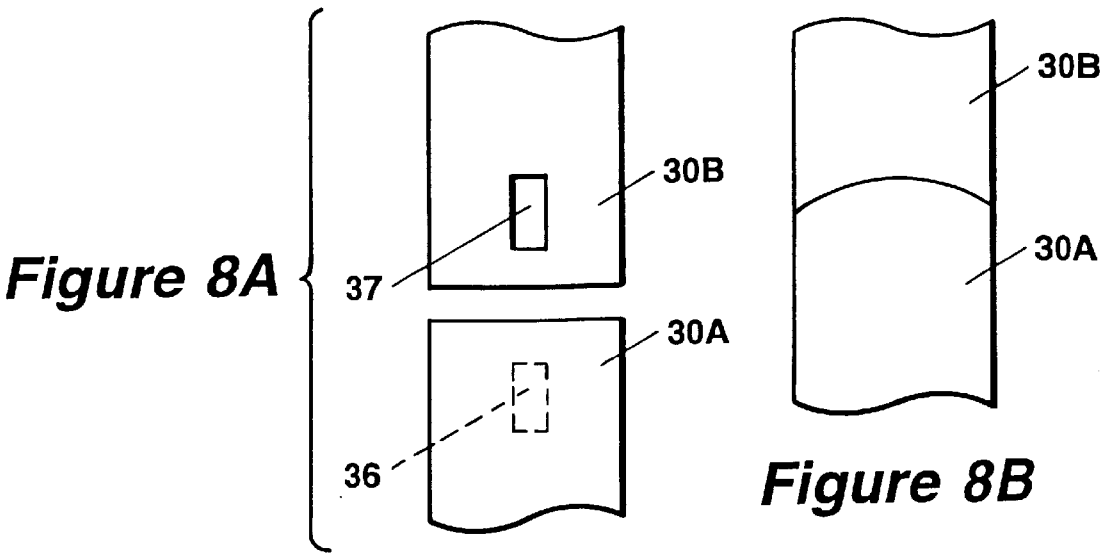
Figure 8B
Figure 8A

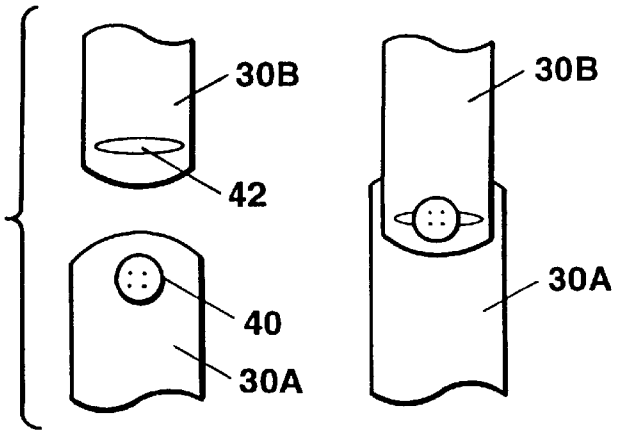
Figure 9A
Figure 9B
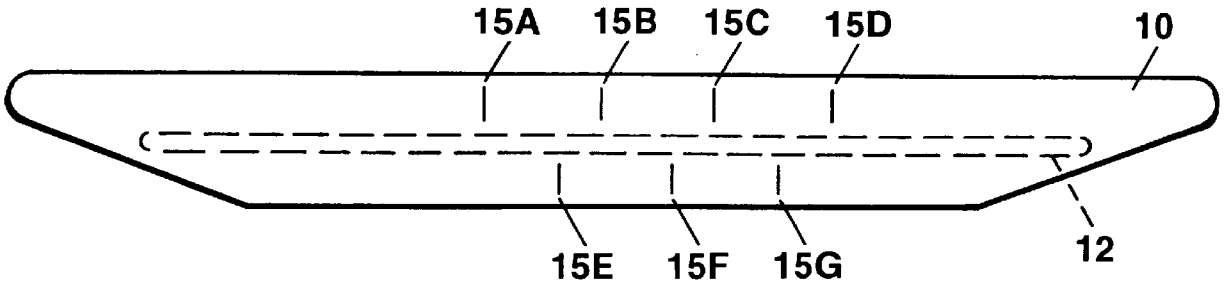
Figure 15

PLIABLE GARMENT TO BE WORN ABOUT THE HEAD

RELATED APPLICATION

This application is a continuation-in-part application of U.S. patent application Ser. No. 08/770,459, filed Dec. 20,1996, now U.S. Pat. No. 5,867,833 entitled PLIABLE GARMENT TO BE WORN ABOUT THE HEAD by Eileen A. LeDonne.

FIELD OF THE INVENTION

The present invention relates to clothing apparel, and, specifically, to a garment which is both pliable and securable about the human head.

BACKGROUND OF THE INVENTION

Numerous articles of clothing are available for wearing on or about the human head. Some articles, such as scarves, bandanas, headbands and hair clips may have both utilitarian function as well as fashionable appeal. Apparel used for winter clothing usually serves the functions of insulating all or a portion of the head. Items such as hats, scarves and headbands are marketed in a variety of sizes for adults as well as children. However, within a specific size category, the items have a "one size fits all" design which typically includes elastic to keep the article close to the head. As a result such items are often overly tight and difficult to fit around one's head, often disturbing one's hairstyle and, particularly for women, one's cosmetic makeup. In addition, children often times resist having such tight fitting garments pulled across their head and face. Other items, such as certain earmuff designs may be selectively sized to one's head by use of a telescoping mechanism connecting the two ear covering elements. Such articles, however, often times do not remain securely on an individual's head, especially during outdoor physical activity. As a result, the comfort and protection derived from the earmuffs is less than optimal.

Accordingly, a need exists for an article of clothing which can be custom fitted to the unique shape of an individual's head, which will not disturb an individual's appearance during dressing, and which provides a secure, comfortable, and protective covering to at least a portion of the head.

SUMMARY OF THE INVENTION

The above-described deficiencies of prior devices and previously described needs are fulfilled by the present invention which contemplates an article to be worn about the head comprising a pliable member capable of being shaped about the head and an external covering surrounding the pliable member. In one embodiment, the pliable member comprises a metal wire and the external covering comprises either a natural or synthetic material. In another embodiment, the movement of the pliable member within the external covering may be limited by partially partitioning the interior cavity formed around the pliable member by the external covering.

BRIEF DESCRIPTION OF THE DRAWINGS

The features, objects and advantages of the invention will be better understood by referring to the following detailed description in conjunction with the accompanying drawing in which:

FIG. 4A illustrates a partial view of an alternative embodiment of the article ends of FIG. 3A when unsecured;

FIG. 6 illustrates a cut away view of an alternative embodiment of the inventive article;

FIG. 8A is a partial view illustrating the article ends of FIG. 6 when unsecured;

FIG. 8B illustrates a partial view of the article ends of FIG. 8A when secured;

FIG. 9A illustrates a partial view of an alternative embodiment of the article ends of FIG. 6 when unsecured;

FIG. 9B illustrates a partial view of the article ends of FIG. 9A when secured;

FIG. 15 illustrates an alternative embodiment of the inventive article of FIG. 12, with the pliable member illustrated in phantom.

DETAILED DESCRIPTION

Figure 1A:
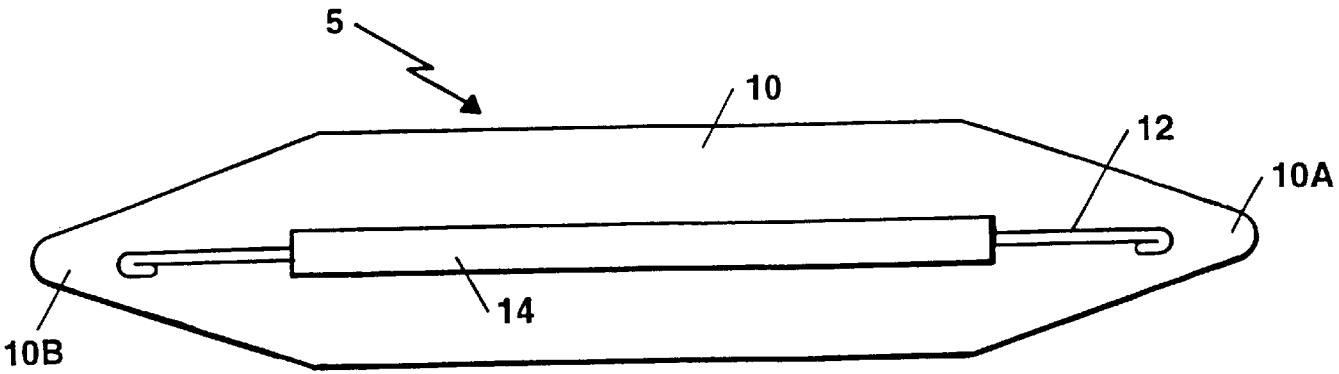
FIG. 1A illustrates the components of the inventive article in a partially assembled relation.
Figure 1B:
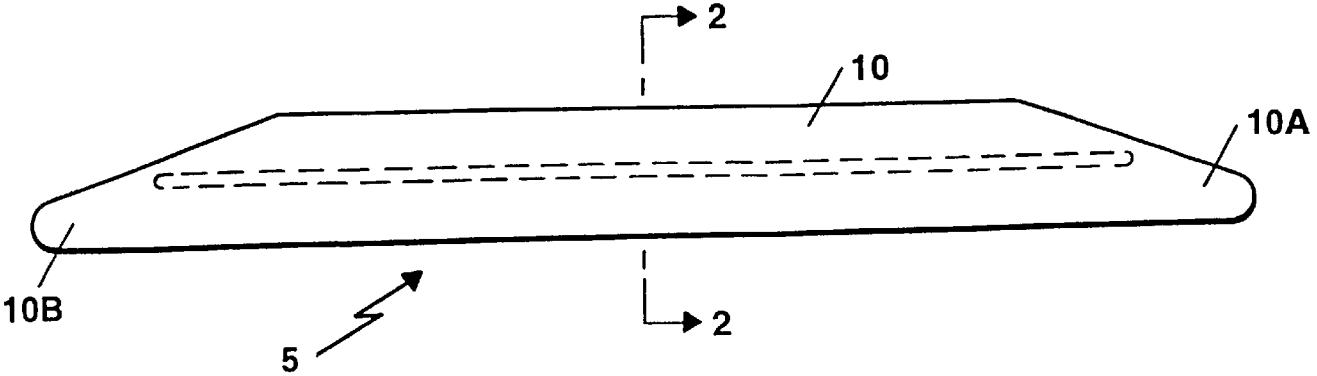
FIG. 1B illustrates the article of FIG. 1A when assembled, with the pliable member illustrated in phantom.
Figure 2:
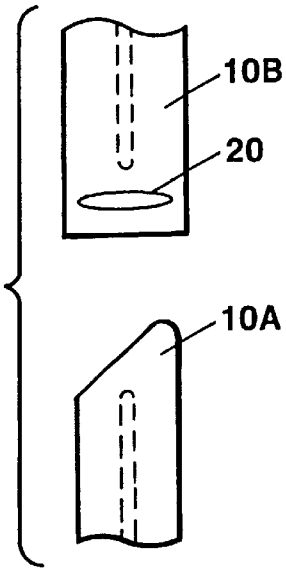
FIG. 2 is a cross-sectional view of the inventive article of FIG. 1B as seen along line 2—2 of FIG. 1B.
Figure 2:
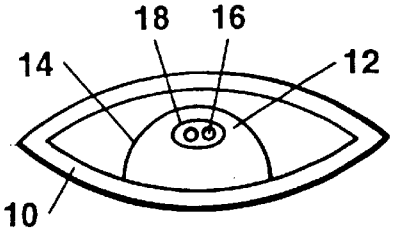

Referring to FIG. 1A, the components of the inventive garment in accordance with the present invention, hereafter referred to as the "article", are illustrated. Article 5 comprises an elongate member 12 contained within an external covering 10. As illustrated in FIG. 1A, elongate member 12 extends substantially the length of external covering 10. In the illustrative embodiment, elongate member 12 has pliable characteristics which allow it to be repeatedly bent or flexed without destroying the patency of the member. In the illustrative embodiment, member 12 comprises a metal wire 16. Alternatively, member 12 may comprise one or more wires, such as a pair of wires housed in a plastic insulative sheathing 18, as illustrated in FIG. 2, similar to standard electrical wire used with thermostats and other electrical devices. Such wire is commercially available from numerous hardware and building supply stores. The ends of the wire are bent to form a rounded surface for safety purposes. The gauge of the wire and the number of wires is a design choice dependent on the amount of pliability and flexibility desired within the article 5. The article is manufactured by placing the member 12 within the external covering 10, which, in the illustrative embodiment, is symmetrical in shape having a first end 10A and a second end 10B. The covering may then be folded in half and secured together, typically by stitching or other means, to form the article as illustrated in FIG. 1B, with member 12 being illustrated in phantom therein. Alternatively, external covering 10 may be formed from a plurality of pieces of material secured together.

Figure 7:
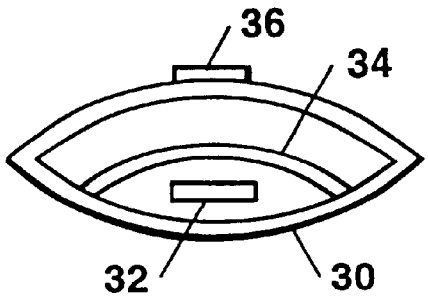
FIG. 7 illustrates a cross-sectional view of the article of FIG. 6 as seen along line 7—7 of FIG. 6.

In addition to metal having dimensions as previously described, other substances may be used for member 12 such as certain plastics which exhibit pliable characteristics similar to metal and which may have either a circular cross section, as illustrated in FIG. 2, or a rectangular cross section, as illustrated in FIG. 7, as described hereinafter.

External covering 10 may comprise any fabric or material which provides insulative properties, including but not limited to naturally occurring fibers such as cotton, wool, or mohair, or synthetic materials, such as Dacron, Rayon, or Polyester. In the illustrative embodiment, a synthetic fleece material known as Polartec commercially available from Malden Mills, Lawrence, Mass. is utilized for external covering 10. The fleece material provides an enhanced degree of warmth to the body surfaces with which external covering 10 comes into contact.

It will be obvious to those reasonably skilled in the arts that other types of materials may be used and that different combinations of material may be used. For instance, the internal side of external covering 10, the side worn next to the body, may comprise a knit material, while the other, external side may comprise a different material such as natural or synthetic animal fur.

To help stabilize the position of member 12 within the external covering, an optional sleeve 14 may be utilized to limit the movement of member 12 within external covering 10, particularly during shaping. The sleeve may comprise a fabric material or a synthetic foam, such as urethane or polyurethane. The sleeve may be secured to the external covering 10 or may remain within external covering 10 through frictional forces. Alternatively, sleeve 14 may comprise one or more securing devices, such as strips of elastic attached to external covering 10. In addition to, or in place of, sleeve 14, a material such as synthetic or natural down or a natural or synthetic batt material may fill any interior cavity between pliable member 12 and external covering 10 to provide both increased insulative properties to article 5 as well as to stabilize the position of pliable member 12 within external covering 10.

Figure 4B:
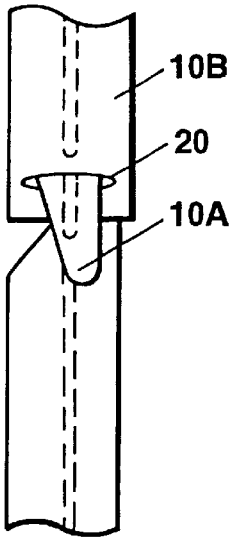
FIG. 4B illustrates a partial view of the article ends of FIG. 4A when secured in accordance with the alternative embodiment.
Figure 5:
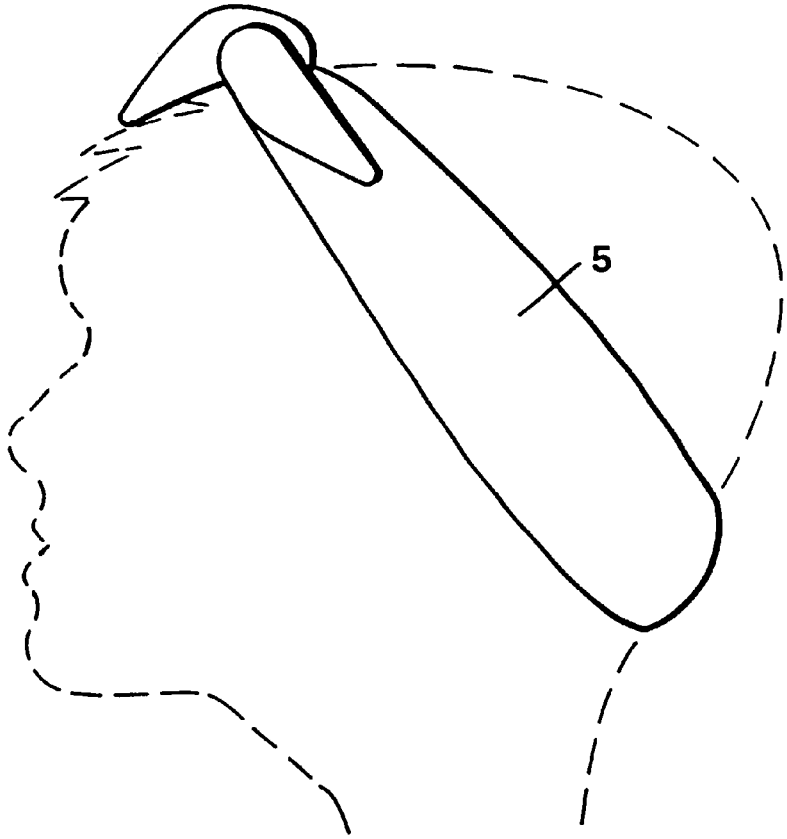
FIG. 5 illustrates the article as worn about the head, with the subject illustrated in phantom.

The article 5 is worn about the head of a subject as illustrated in FIG. 5. First, the article is centered about the back of the neck. Next, the user forms the shape of member 12 about the head so that the article wraps comfortably along the sides of the head and partially around the ears so that ends 10A and 10B meet at the top of the head. Finally, article ends 10A and 10B are secured in a manner as illustrated with reference to FIGS. 3 and 4.

Figure 3A:
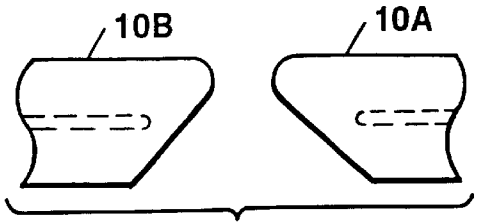
FIG. 3A illustrates a partial view of the unsecured ends of the article of FIG. 1B.
Figure 3B:
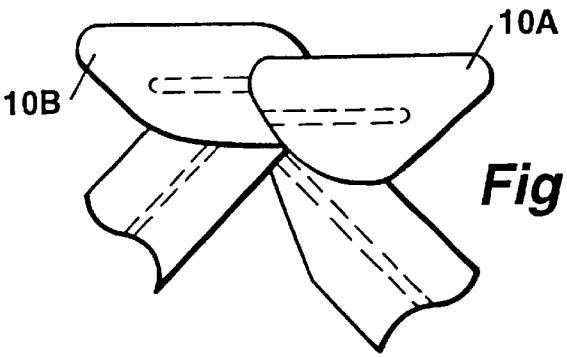
FIG. 3B illustrates a partial view of the article ends of FIG. 3A when secured.

Referring to FIG. 3A, first end 10A and second end 10B of article 5 are illustrated in an unsecured relation to one another. FIG. 3B illustrates the ends 10A and 10B bent into J-shapes and wrapped about each other in a manner similar to that shown in FIG. 5 to ensure a secure fit about the head of the subject. The pliable member 12 facilitates securing of the ends about one another by simply bending one end around the other end without requiring a knot or other securing means.

As will be appreciated from the above description, the article of apparel as disclosed herein provides a garment which can be easily secured about the head to provide a comfortable protective covering to a portion of the head and ears, and which is custom fit to the unique shape of the individual's head.

An alternative embodiment to the embodiments of FIGS. 1–3 is illustrated in FIG. 4. In this embodiment, end 10B has a nontapered end with a hole or eyelet 20 extending therethrough. To secure end 10A to end 10B, the tapered end of 10A is slipped through the eyelet 20 and bent backward as illustrated in FIG. 4B. Pliable member 12 provides the means by which end 10A is held in place, as illustrated.

Referring to FIG. 6, another alternative embodiment of the article of the present invention is illustrated. Article 25, as illustrated, comprises an external covering 30 having a pliable member 32 extending substantially the length thereof, similar to the embodiment shown in FIG. 1. Ends 30A and 30B of external covering 30, however, do not have a tapered shapes. Further, the means by which ends 30A and 30B may be secured include additional securing means, as described hereinafter. In the embodiment disclosed in FIG. 6, pliable member 32 comprises an elongate metal or plastic element having a rectangular cross section. Optionally, one or more straps 34 may be attached to external covering 30 to facilitate stabilizing the position of the member 32 while still allowing movement of the member within external covering 30. FIG. 7 illustrates a cross sectional view of article 25 as seen along lines 7—7 of FIG. 6. Straps 34 may comprise elastic or other materials.

Article 25 is secured about the head of a subject in a manner similar to that previously described, with reference to FIG. 5 except that ends 30A and 30B are secured differently. Referring to FIGS. 8A–B, a VELCRO-like securing mechanism is illustrated. Specifically, element 36 may comprise a dense array of tiny nylon hooks while element 37 comprises a dense nylon pile. When pressed together, elements 36 and 37 frictionally engage, securing end 30A and 30B, as illustrated in FIG. 8B. Alternatively, the means for securing ends 30A and 30B may comprise a button 40 attached to end 30A and a hole or eyelet 42 extending through end 30B, as illustrated in FIG. 9A, which may be joined in a conventional manner as illustrated in FIG. 9B. Although not illustrated, other securing mechanisms such as snaps, hook/eyelet, etc., may be used in place of elements 36–37 of FIGS. 8A–B or button 40 and eyelet 42 of FIGS. 9A–B.

In the embodiments disclosed in FIGS. 6–9, although the pliable member 32 does not provide the means by which the respective ends remain secured, member 32 still serves to ensure a close fit about the head and ears of the subject and enables the respective ends to be brought into close contact for securing by the respective disclosed securing devices.

Figure 10A:
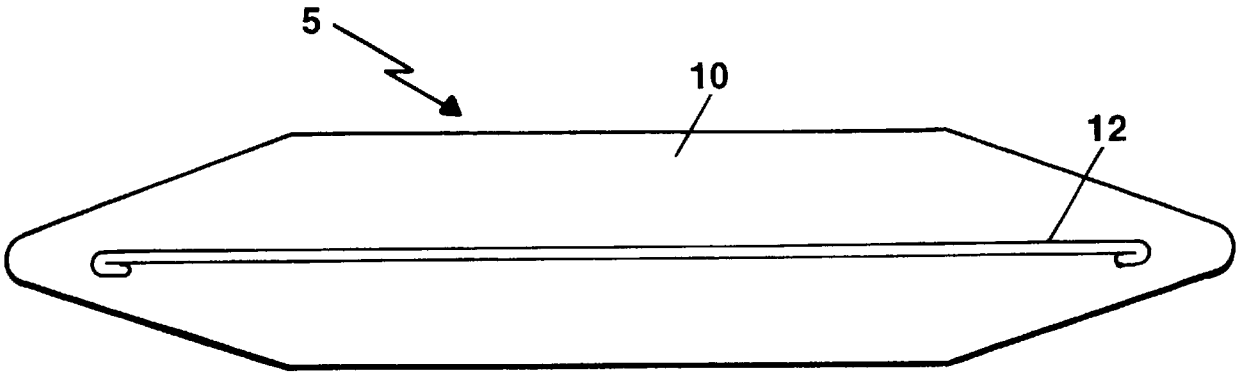
FIG. 10A illustrates the components of an alternative embodiment of the inventive article in a partially assembled relation.

Alternative embodiments of the inventive article 5 are illustrated in FIGS. 10A–15. In these embodiments, the interior cavity between member 12 and external covering 10 is partitioned in a manner so as to limit the movement of member 12 within external covering 10, as explained hereinafter. Referring to FIG. 10A, an alternative embodiment of the article in shown in FIG. 1A is illustrated. Specifically, FIG. 10A discloses an embodiment in which the optional sleeve 14 has been eliminated. In this embodiment, the article 5 comprises an external covering 10 having member 12 extending partially along the length of the external covering 10. To stabilize the position of member 12 within the external covering, the external covering itself is secured onto itself by stitching 15A to limit movement of member 12 within the external covering, particularly, during shaping. Such alternative embodiment is illustrated in FIG. 10B in which member 12 is illustrated in phantom. As shown in FIG. 10B, stitching 15A is disposed adjacent member 12 for a portion of the length of member 12. Stitching 15A extends through the walls of external covering 10, effectively partitioning the interior cavity defined by external covering 10 so as to confine member 12 between stitching 15A and the edge of external covering 10, along a portion of the article. As a result, the movement of member 12 in directions generally perpendicular to the long axis of member 12 is limited.

Figure 10B:
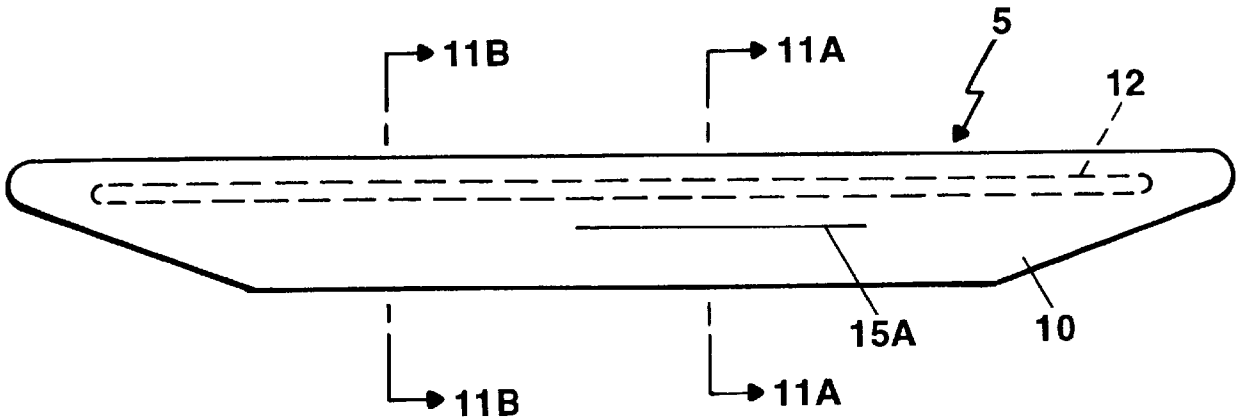
FIG. 10B illustrates the article of FIG. 10A when assembled, with the pliable member illustrated in phantom.
Figure 11B:
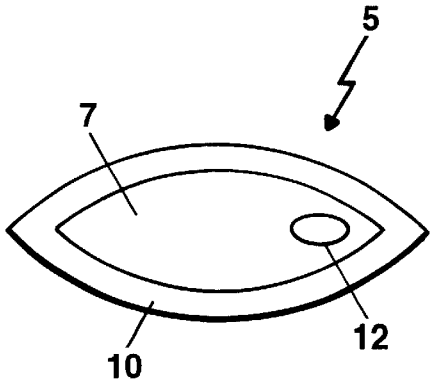
FIG. 11B is a cross-sectional view of the inventive article of FIG. 10B as seen along line 11B—11B of FIG. 10B.
Figure 11A:
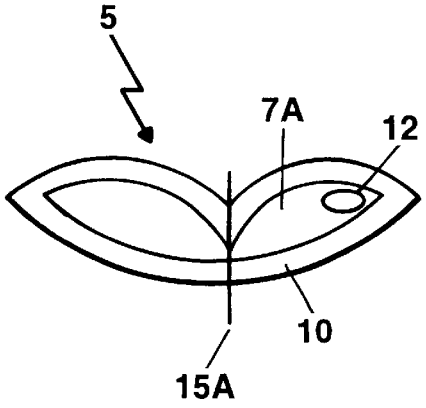
FIG. 11A is a cross-sectional view of the inventive article of FIG. 10B as seen along line 11A—11A of FIG. 10B.

FIG. 11A is a cross sectional view of the article of FIG. 10B as seen along line 11A—11A of FIG. 10B. As illustrated in FIG. 11A, stitching 15A secures the walls of external covering 10 together to form an interior cavity 7A of reduced area through which member 12 extends. In this manner, the external covering 10 itself provides a pseudo "sleeve" which limits movement of member 12 within external covering 10 and thereby stabilizes the position of member 12 during bending. It will be obvious to those reasonably skilled in the art that the position of member 12 within external covering 10 as well as the length of stitching 15A and its distance from member 12 are design choices dependent on the amount of flexibility and allowable movement desired for member 12. For example, the point at which external covering 10 is secured against itself and adjacent member 12 may be placed toward the center of the sleeve, as illustrated in FIG. 12.

FIG. 11B is a cross sectional view of the article of FIG. 10B as seen along line 11B—11B of FIG. 10B. As illustrated in FIG. 11B, member 12 remains free to move within the unpartitioned interior cavity 7 formed by external covering 10 away from stitching 15A.

Figure 12:
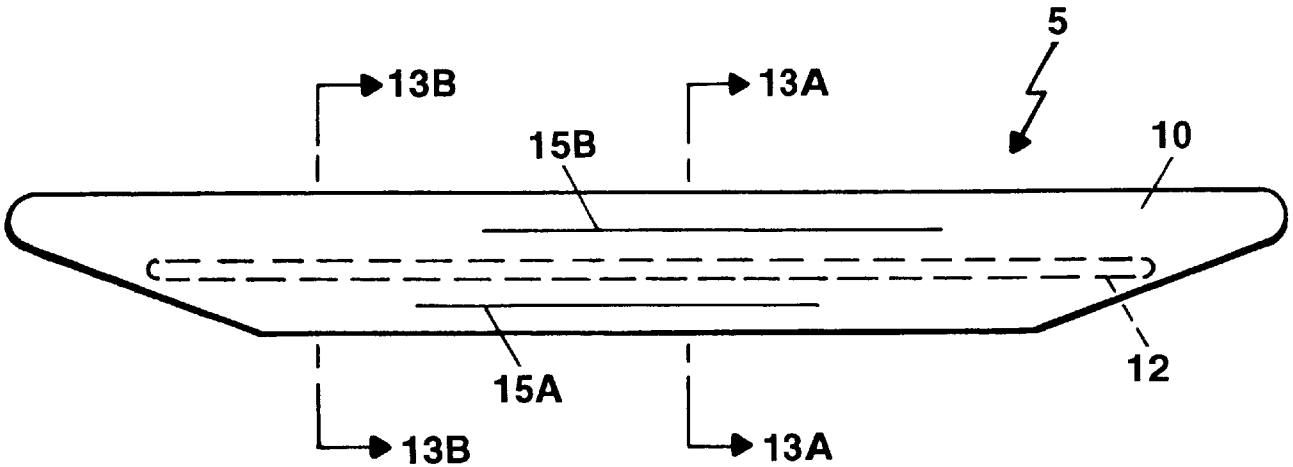
FIG. 12 illustrates an alternative embodiment of the invention with the pliable member illustrated in phantom.

Referring to FIG. 12, an alternative embodiment of the article in shown in FIG. 1A is illustrated. Specifically, FIG. 12 discloses another embodiment in which the optional sleeve 14 has been eliminated. In this embodiment, the article 5 comprises an external covering 10 having member 12 extending partially along the length of the external covering 10. To stabilize the position of member 12 the external covering is secured onto itself by stitching 15A and 15B thereby limiting movement of member 12 within the external covering, particularly, during shaping. As shown in FIG. 12, stitching 15A and 15B extend adjacent member 12 for a portion of the length of member 12.

Figure 13B:
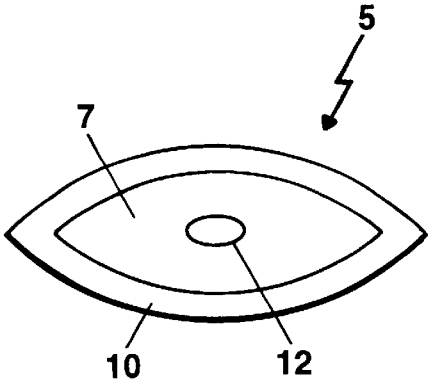
FIG. 13B is a cross-sectional view of the inventive article of FIG. 12 as seen along line 13B—13B of FIG. 12.
Figure 13A:
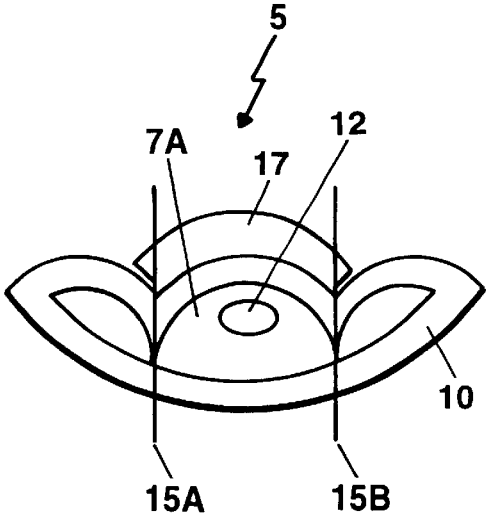
FIG. 13A is a cross-sectional view of the inventive article of FIG. 12 as seen along line 13A—13A of FIG. 12.

FIG. 13A is a cross sectional view of the article of FIG. 12 as seen along line 13A—13A of FIG. 12. As illustrated in FIG. 13A, the stitching 15A and 15B secure portions of the external covering walls together to form an interior cavity 7A of reduced area through which member 12 extends. In this manner, the external covering 10 itself provides a pseudo "sleeve" which limits movement of member 12 within external covering 10, and, thereby stabilizes the position of member 12 during bending. It will be obvious to those reasonably skilled in the art that the position of member 12 within external covering 10 as well as the length of stitching 15A and 15B and their distance from member 12 are designed choices dependent on the amount of flexibility and allowable movement desired for member 12. For example, the point at which the walls of external covering 10 are secured together and around member 12 by stitching 15A and 15B may be chosen away from the center of the interior cavity formed by covering 10. In FIG. 13A, an optional piece of material 17, not shown in FIG. 12, may be attached to the exterior of covering 10 by stitching 15A and 15B. In one implementation, material 17 may comprise a label which may be attached to external covering 10 by stitching 15A or 15B or both.

FIG. 13B is a cross sectional view of the article of FIG. 12, as seen along lines 13B—13B of FIG. 12. As illustrated in FIG. 13B, member 12 is free to move within the unpartitioned portion of the interior cavity 7 formed by defined by external covering 10.

Figure 14:
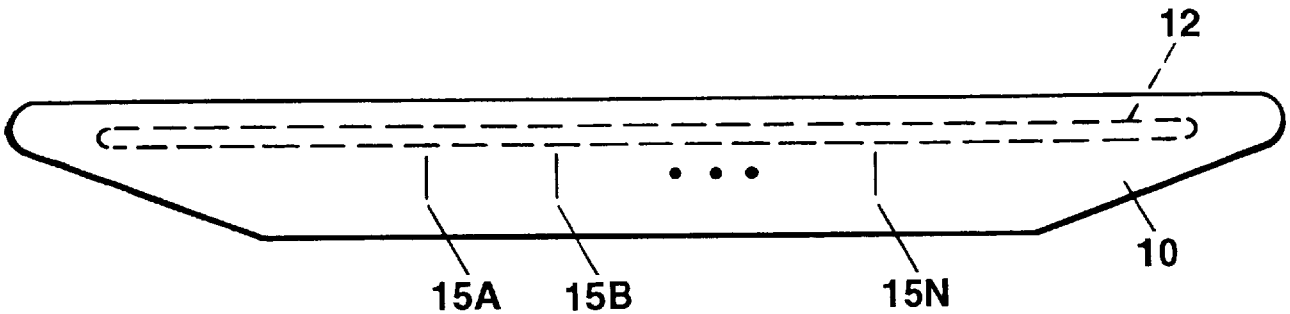
FIG. 14 illustrates an alternative embodiment of the inventive article illustrated in FIG. 10B.

FIG. 14 illustrates an alternative embodiment of the article shown in FIG. 10A in which one or more stitchings 15A–N, perpendicular to the longer axis of pliable member 12, are used to partition the interior cavity defined by external covering 10 and to secure portions of the exterior walls of covering 10 together.

FIG. 15 illustrates an alternative embodiment of the article shown in FIG. 12 in which one or more stitchings 15A–N, perpendicular to the longer axis of pliable member 12, are used to partition the interior cavity defined by external covering 10 and to secure portions of the walls of covering 10 together.

In the embodiments of the inventive article illustrated in FIGS. 14 and 15, although the stitchings 15A–N are disposed perpendicular to the long axis of pliable member 12, an effective partitioning of the interior cavity between pliable member 12 and external covering 10 is accomplished. The stitches 15A or 15B do not have to extend parallel to either member 12 or external covering 10, and, may be disparate lengths. It will be obvious to those reasonably skilled in the arts that the number, length, shape and pattern of stitching 15A–N utilized to effectively partition the interior cavity of covering 10 may be selected depending on the amount of flexibility and allowable movement desired for member 12. Stitches 15, as illustrated in the figures may be implemented in a conventional manner using traditional textile sewing apparatus and may comprise either natural or synthetic thread or filament. Alternatively, or in addition to stitches 15, other devices such as staples, adhesives, thermal fusing, etc. may be utilized to attach portions of the walls of external covering 10 together to partition the interior cavity 7 and stabilize the motion of member 12 within the cavity 7.

A method of manufacturing the inventive article 5 as illustrated in any of FIGS. 10–15 comprises the steps of forming an exterior covering of material into a sleeve defining an interior cavity, disposing an elongate pliable member within the interior cavity and extending partially along the length of the sleeve, and partitioning a portion of the interior cavity by securing non-edge walls of the cavity together so as to limit movement of the pliable member within the interior cavity. As mentioned previously, the sleeve formed by external covering 10 may comprise multiple pieces of materials secured together. In addition, the means by which the interior cavity is partitioned, whether by stitching or other means, as well as the number, size and shape of the partitions may be chosen in accordance with the amount of flexibility and desired movement of member 12 within the external sleeve 10.

Although various exemplary embodiments of the invention have been disclosed, it will be apparent to those skilled in the art that various changes and modifications can be made which will achieve some of the advantages of the invention without departing from the spirit and scope of the invention. These and other obvious modifications are intended to be covered by the appended claims.

What is claimed is:

1. An article of apparel to be worn around the human head comprising:

an elongate sleeve of fabric having a length extending between first and second sleeve ends, the elongate sleeve defining a closed interior cavity;

an elongate pliable member having first and second pliable member ends, the elongate pliable member disposed within the closed interior cavity defined by the elongate sleeve and extending along a majority of the length of the elongate sleeve and through the interior cavity defined by the elongate sleeve between the first and second sleeve ends; and means, disposed intermediate the first and second pliable member ends, for partially partitioning the closed interior cavity and for limiting movement of the elongate pliable member within the closed interior cavity.

2. The article of claim 1 wherein the means for partitioning comprises:

at least one stitch extending through a portion of the elongate sleeve and adjacent the pliable member.

3. The article of claim 1 wherein the means for partitioning comprises:

a plurality of stitches extending through a portion of the elongate sleeve and adjacent the pliable member.

4. The article of claim 3 wherein the plurality of stitches extend substantially parallel to the pliable member.

5. The article of claim 3 wherein the plurality of stitches extend substantially perpendicular to the pliable member.

6. A method for making an article of apparel comprising the steps of:

(a) providing an elongate sleeve of material having a length extending between first and second sleeve ends and defining an interior cavity;

(b) disposing an elongate pliable member having first and second pliable member ends within the interior cavity and extending along a majority of the length of the elongate sleeve between the first and second sleeve ends;

(c) partitioning the interior cavity of the elongate sleeve in the proximity of the elongate pliable member so as to restrict movement of the elongate pliable member within the interior cavity of the elongate sleeve; and (d) closing the interior cavity.

7. An article comprising:

an elongate sleeve of fabric having a length extending between first and second sleeve ends, the elongate sleeve defining a closed interior cavity;

an elongate pliable member having first and second pliable member ends, the elongate pliable member disposed within the closed interior cavity defined by the elongate sleeve and extending along a majority of the length of the elongate sleeve between the first and second sleeve ends; and disposed intermediate the first and second pliable member ends, and extending through a portion of the elongate sleeve and adjacent the pliable member for stabilizing the position of the elongate pliable member within the closed interior cavity.

8. The article of claim 7 wherein the means for partitioning comprises:

a plurality of stitches extending through a portion of the elongate sleeve and adjacent the pliable member.

9. The article of claim 8 wherein the plurality of stitches extend substantially parallel to the pliable member.

10. The article of claim 8 wherein the plurality of stitches extend substantially perpendicular to the pliable member.

11. An article comprising:

an elongate sleeve of fabric having a length extending between first and second sleeve ends, the elongate sleeve defining a closed interior cavity;

an elongate pliable member having first and second pliable member ends, the elongate pliable member disposed within the closed interior cavity defined by the elongate sleeve and extending along a majority of the length of the elongate sleeve between the first and second sleeve ends; and a second sleeve, attached to the elongate sleeve, for stabilizing the position of the elongate pliable member within the closed interior cavity.

* * * * *